United States Patent [19]

Lay

[11] Patent Number: 4,830,371

[45] Date of Patent: May 16, 1989

[54] BALL HITTING PRACTICE DEVICE

[75] Inventor: William C. Lay, Midvale, Utah

[73] Assignee: Grand Slam, Inc., Midvale, Utah

[21] Appl. No.: 30,366

[22] Filed: Mar. 26, 1987

Related U.S. Application Data

[63] Continuation-in-part of Ser. No. 875,065, Jun. 17, 1986, Pat. No. 4,681,318.

[51] Int. Cl.[4] ..... A63B 69/36

[52] U.S. Cl. ..... 273/26 E; 248/516; 273/26 R

[58] Field of Search ..... 273/26 R, 29 A, 26 E, 273/33, 202, 203, 204, 207, 209, 211, 212, 184 R, 184 B, 197 A; 272/76, 77, 78; 248/514, 516, 523, 160

[56] References Cited

U.S. PATENT DOCUMENTS

| | | | |
|---|---|---|---|
| 63,517 | 4/1867 | Heermance | 248/515 |
| 2,527,906 | 10/1950 | Bennett et al. | 273/26 R |
| 2,862,712 | 12/1958 | Delia et al. | 273/26 E |
| 3,039,770 | 6/1962 | Ferretti | 273/26 R |
| 3,139,282 | 6/1964 | Lande | 273/26 R |
| 3,540,406 | 11/1970 | Dexter | 248/515 |
| 3,612,454 | 10/1971 | Linn | 248/515 |
| 3,813,097 | 5/1974 | Darby | 273/25 |
| 4,042,237 | 8/1977 | Moraru | 273/29 A |
| 4,136,869 | 1/1979 | Tassone | 273/26 R |
| 4,681,318 | 7/1987 | Lay | 273/26 R |

FOREIGN PATENT DOCUMENTS

| | | | |
|---|---|---|---|
| 2548914 | 1/1985 | France | 273/29 A |

*Primary Examiner*—Richard C. Pinkham
*Assistant Examiner*—T. Brown

[57] ABSTRACT

A new type of baseball and softball practice hitting device which is easily adjusted for use in training young ball players comprising a planar base to which is attached vertical sections, the top end of the pedistal being fixedly attached to a baseball or softball, and the bottom end of said vertical pedistal being fixedly attached to a coil spring which in turn is attached to a pivoting member which permits the pedistal to be inclined to the side, back or front depending on the desired position of the ball and then locked in place.

9 Claims, 3 Drawing Sheets

BALL HITTING PRACTICE DEVICE

This application is a continuation-in-part of my patent application Ser. No. 875,065, filed June 17, 1986 now Pat. No. 4,681,318.

BACKGROUND OF THE INVENTION

1. Field of the Invention

This invention relates to a new practice batting or hitting device. More particularly, the invention relates to a baseball or softball practice hitting device that avoids the necessity of retrieving the ball after the practice swing.

Specifically, the invention provides a new type of baseball and softball practice hitting device that is easily adjusted for use in training young ball players and which avoids the necessity of retrieving the ball after the practice swing. The new practice hitting device broadly comprises in combination a planar base adapted to being placed on a relatively flat surface, such as the ground, a vertical pedistal fixedly attached to said base, said pedistal comprising an elongated vertical member having a ball fixedly attached to the terminal end of said member and the other end of the vertical member being fixedly attached to an elongated coil spring adapted to permitting the vertical pedistal to bend forward when the ball is hit, pivoting means fixedly attached to the bottom end of the coil spring and to the surface of the planar base, said pivoting means being adapted to permitting the vertical pedistal to be inclined to the sides, front or back and then locked in the desired position.

The invention further provides a preferred embodiment wherein the elongated vertical member comprises in combination a first vertically extending resilient member having the ball fixedly attached to one end thereof and having its other end fitting into the upper end of a second vertically extending tubular member in telescopic manner so as to permit said resilient member to be adjusted up and down, locking means to secure said first resilient member in a desired position, and the end of said second vertically extending tubular member being attached to the above mentioned elongated coil.

As a further special embodiment, the invention provides the above-described practice hitting devices possessing attachments to the planar base which permits the addition of weights so as to allow the practice device to be used on surfaces, such as indoor floors, etc.

2. Prior Art

In the game of baseball, one of the most difficult skills to master is hitting. First, a hitter must be able to coordinate the swing of a bat with the location of a ball so that good contact with the ball can be made while swinging the bat. Once this is mastered, the hitter must next learn to make good contact with the ball at the various positions at which it may cross home plate, from an inside pitch to an outside pitch, and from a high pitch to a low pitch, and various combinations of these two variables.

In development of these skills, the trainer or coach uses a baseball tee to support a ball at a selected height above a representation of the baseball home plate. The player then hits the ball out to the field, the ball is retrieved and placed on the tee for another swing. In this manner, the player can practice swinging and improve the coordination of his hands and eyes and develop his wrist and arm muscles.

Various practice batting tees have been developed in the past for this purpose. The practice tees developed to date, however, have had various limitations which have discouraged their overall acceptance in the baseball world.

In most cases, the ball is positioned on the tee and hit out into the field. This requires someone to retrieve the ball for the next hit. This has become very tiring work and discouraging to some players. In other cases, the tees have not been adjustable and different tees must be used for different hitting zones. In other cases the tees have been partially adjustable, but not able to cover all the hitting zones. In some cases, the tees have been adjustable, but the adjustment has required considerable time and manipulation to obtain a tee in the desired position. In other cases, the tees have been very expensive to produce, and the cost has been prohibitive for many of the smaller teams.

Following are examples of the prior art which disclose many of the tees having the above-noted limitations. U.S. Pat. Nos. 4,383,686, 4,277,691, 4,516,771, 2,862,712, 4,508,340, 3,877,695, 2,616,692 and 3,489,411.

The following patents disclose practice hitting devices wherein the ball is attached to a string and can be hit again when the string stops swinging or is retrieved: U.S. Pat. Nos. 4,050,694, 3,885,790, 3,716,235, 3,623,725. U.S. Pat. No. 3,794,320 discloses a device wherein the ball is attached to an arm which rotates 90 degrees, but is unable to be adjusted to various types of pitches.

It is an object of the invention, therefore, to provide a new practice hitting device for baseball and softball which corrects many of the above-described limitations. It is a further object to provide a practice hitting device which avoids the necessity of retrieving the ball after being hit. It is a further object to provide an adjustable practice hitting device which is adjustable and can be set for any hitting zone that a batter would experience in a normal game. It is a further object to provide a hitting device that can be easily and quickly adjusted to a new hitting position. It is a further object to provide a new adjustable hitting device which can be produced at low cost and can be made available to all softball and baseball teams. These and other objects of the invention will be apparent from the following detailed description thereof.

SUMMARY OF THE INVENTION

It has now been discovered that these and other objects may be accomplished by the new adjustable practice hitting device of the present invention which presents for the first time an efficient and economical way for the training of young batters in all aspects of the hitting techniques.

The new practice hitting device of the present invention broadly comprises in combination a planar base adapted to being placed on a relatively flat surface, such as the ground, a vertical pedistal fixedly attached to said base, said pedistal comprising an elongated vertical member having a ball fixedly attached to the terminal end of said member and the other end of the vertical member being fixedly attached to an elongated coil spring adapted to permitting the vertical pedistal to bend forward when the ball is hit, pivoting means fixedly attached to the bottom end of the coil spring and to the surface of the planar base, said pivoting means being adapted to permitting the vertical pedistal to be inclined to the sides, front or back and then locked in the desired position.

A preferred embodiment of the invention comprises the above-described practice hitting device wherein the elongated vertical member comprises in combination a first vertically extending resilient member having the ball fixedly attached to one end thereof and having its other end fitting into the upper end of a second vertically extending tubular member in telescopic manner so as to permit said resilient member to be adjusted up and down, locking means to secure said first resilient member in a desired position, and the end of said second vertically extending tubular member being attached to the above mentioned elongated coil.

As a further special embodiment, the invention provides the above-described practice hitting device possessing attachments to the planar base which permits the addition of weights so as to allow the practice device to be used on surfaces, such as indoor floors, etc.

It has been surprisingly found that the new practice batting device described above solves many of the defects noted for the prior art devices. The new practice batting device, for example, avoids the necessity of retrieving the ball after the practice swing as the ball is firmly attached to the pedistal. After the ball has been hit, the pedistal bends forward and then quickly recovers its original position as a result of the coil spring at the base of the pedistal. Furthermore, the preferred new device is easily adjusted to the desired height for the individual batter by lowering or raising the first resilient round member. In addition, the pedistal can be adjusted for the various types of pitches, such as inside, outside balls, by adjustment of the pivoting means at the base of the pedistal. The new preferred device with the added features on the base also permit the new practice batting device to be used inside, such as on carpeted areas in the home or school. The new device is also inexpensive to produce and can be made available at low cost to all coaches and trainers involved in training young ball players.

DESCRIPTION OF THE DRAWING

The various objects and features of the present invention will be more fully understood by reference to the accompanying drawings.

With reference to FIG. 1, the base plate having the conventional base size is shown as 10, with the apertures or holes for placing of stakes to secure the plate to the ground is shown as 11. The pedistal attached to the base plate is shown as 27. The vertical member holding the ball 13 is shown as 22. The elongated coil spring is shown as 19, the pivoting means, such as a ball joint is shown as 18 which permits the pedistal to be moved to the right and left, and means for locking the pivoting means in the desired position is shown as 21.

With reference to FIG. 2 which illustrates the preferred embodiment wherein an adjustable member is introduced in the pedistal, the base plate is shown as 10, with the apertures for placing the stakes to secure the plate to the ground as 11. The pedistal firmly fixed to the base plate is shown as 12. The vertical member holding the ball is shown as 14. The ball 13 is firmly attached to the vertical member by any suitable means, such as by injection molding, adhesives, screws, clamps, tape, etc. In some cases, the vertical member 14 can be eliminated and the ball firmly attached to the first resilient tubular member 15. Tubular member 15 fits inside of the second resilient tubular member 16 and is held at the desired height by locking means 17. The base of the second resilient tubular member 16 is fixedly attached to the top of coil spring 19 which in turn is fixedly attached at the bottom of the spring to the top of pivoting means 18. By locking means 21, the pedistal is lock in the desired position, such as to the right or left. The pivoting means is fixedly attached to the base plate by means of a bolt from underneath 20.

FIG. 3 illustrates a preferred method of adjusting the height of the pedistal wherein tubular member 15 is placed inside of tubular member 16 to the right depth, and lock nut 23 is then tightened over split bolt 24 to hold 15 in the proper position.

FIG. 4 illustrates the embodiment of the invention wherein weight extension holders 26 are attached to base plate 25 and weights, illustrated by 30, are placed on the extensions so as to hold the base down when employing the batting device indoors or other surfaces where it is impractical to insert the stakes to hold the plate in place.

DETAILED DESCRIPTION OF THE INVENTION

Figure 1:
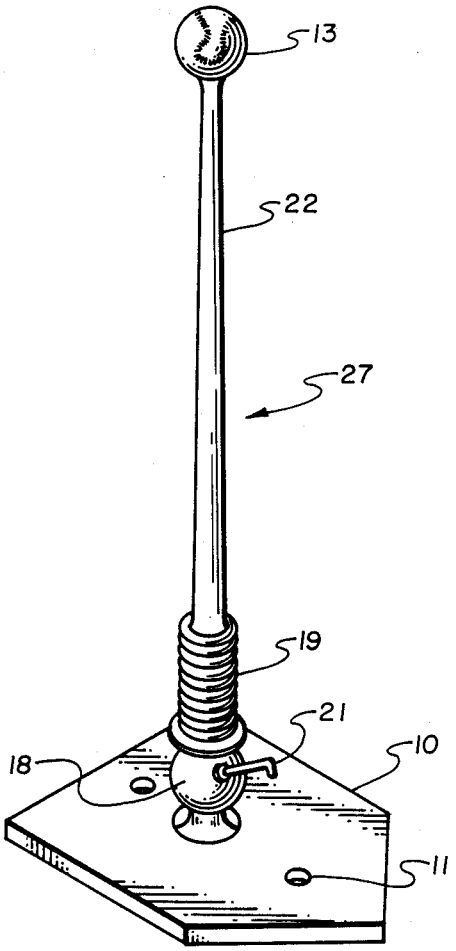
FIG. 1 is a perspective drawing of the new practice batting device of the present invention without the up and down adjustable feature.
Figure 2:
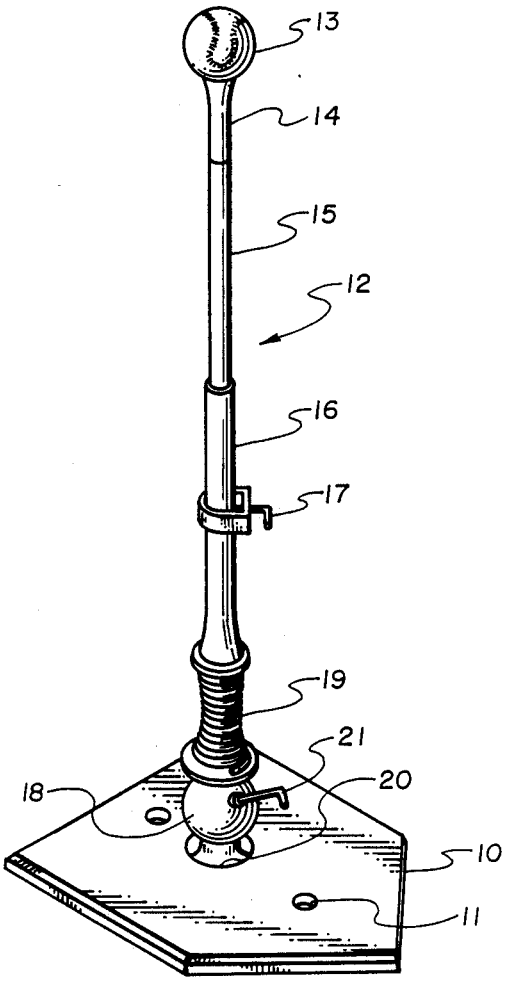
FIG. 2 is a perspective view of the new practice batting device showing the preferred embodiment containing the resilient and adjustable members.

While the above-described description of the invention and drawings have been made in rather specific terms, it should be understood that various changes can be made in construction and operation without departing from the scope of the invention.

The planar base for the hitting device may be of any desired shape or size, and of any suitable material as long as it provides the base for the attachment of the upright pedistal and support therefor when the ball is hit. In general, the base is of the conventional baseball shape and is made from wood and hard rubber. The conventional shape of the baseball plate is 17″×17″ and is preferably white so it can be easily seen.

As noted, the planar base should be secured to a solid surface so that the pedistal can swing back after being hit. The plate may be secured to such a surface, as the ground, by any suitable means. Preferably the plate is secured by the insertion of several long pins through holes in the plate as shown by 11 in the drawing. One preferably employs at least two and generally from 2 to 4 such pins to hold the plate on the desired surface. Such pins are preferably prepared from metal, such as iron or steel or aluminum.

Sometimes it may be desirable to utilize the new practice hitting device indoors or on a gym floor rather than on the ground outside. In that case, it is desirable to employ weight extender holders 26 with tip 29 fitting into openings 30 in the base plate. Peg 28 is to hold the weights on the extenders. These extenders are generally metal or plastic plates or sheets constructed so as to be removably attached to the base such as shown in the drawing and to hold the weights. In general metal weights of 20 to 50 lbs can be applied on both sides of the base on the said extender holders. Such extenders generally vary in size from about 12 inches by 12 inches to 14 inches by 14 inches.

As shown above, the ball for which training is desired is fixedly attached to the top of the vertical pedistal.

The ball employed may be of any suitable type, such as the general practice baseball or a plastic molded baseball or softball, called a Whiffle ball, or it may be a regular baseball or softball which has been attached by adhesive, screws, tape, or the like or actually nolded on the top part of the pedistal.

As shown in FIG. 1, the desired ball is fixedly attached to the top of the vertical pedistal 27. This upright vertical pedistal is preferably made of metal, plastic or hard rubber. It is generally made of a highly flexible material so that in the event the hitter misses the ball and hits the pedistal it may absorbe the hit without destroying the pedistal. This single type pedistal generally varies in length from about 20 inches to about 30 inches in length, but can be varied to fit the size of the hitter. The single type pedistal is generally a solid fiber glass rod or a plastic tubular member which has the desired flexibility if hit by the bat. The pedistal preferably varies from about ¾ inches to about 1¼ inches in diameter. However, other sizes may be used as desired or necesary.

In the preferred embodiment of the present invention, the pedistal is not a single vertical member but is made up of 2 or more segments which preferably fit together in telescopic manner to form the said pedistal. In this preferred embodment, the base is attached to the top of a short vertical upright 14. This upright is preferably made of rubber or a highly flexible material so that in the event the hitter misses the ball and hits the pedistal it may absorbe the hit. This 14 is preferably a solid rubber member of about ½ to ¾ inches in diameter and having a length of about 3 to 6 inches. As noted, this member may be eliminated, if desired, and the ball attached directly to the first resilient member described below.

The first resilient round member 15 shown in the drawing may be of a solid rod or tubular member adapted to fitting into the inside of tubular member 16. The member 15 may be prepared from any suitable material, but again is preferably prepared as a solid fiber glass rod ranging in general from about ¼ inch to 1 inch in diameter. The length of this first resilient round member may vary as desired, but generally will be from about 10 to 20 inches.

The second resilient tubular member 16 is a round tubular member adapted to having the first resilient member slip down inside in telescopic manner. This resilient member may also be prepared from any suitable material, such as fiber glass, plastic, metal and the like. The diameter of the resilient member 16 should be sufficient for 15 to fit inside, and is thus preferably from ½ to 1 inch in diameter. The length of this member 16 may vary over a wide range as desired, but generally will be from about 10 to 20 inches. It should be noted that while the preferred method of telescopic attachment is noted above as being where the first member fits within the second member, it is also within the scope of the present invention wherein the first member telescopically fits over the outside of the second member with appropriate locking means.

The locking means used to secure the first resilient vertical member at the proper height may be of any suitable type. It is preferably a threaded lock bolt placed in a sleeve over the second resilient member and threaded into a hole in the said second resilient member such that when the bolt is sent through the hole the bolt presses against the first resilient member and holds it in place.

Figure 3:
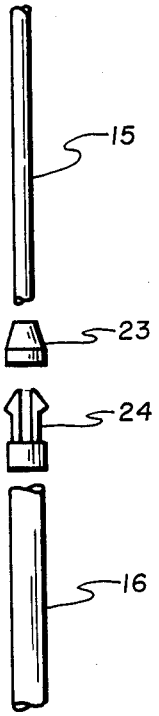
FIG. 3 illustrates a modified method of locking the adjustable member to the pedistal.
Figure 4:
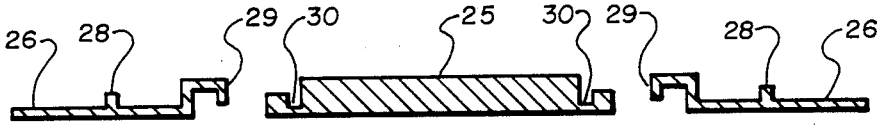
FIG. 4 illustrates the special embodiment of the planar base where extensions are provided for addition of weights.

A second preferred locking means is shown in Figure 3 wherein a nut 23 is tightened down on press split bolt 24 which tightens against the end of the first extended member which is fitted inside the second member.

A coil spring is fixedly attached to the bottom of the second resilient member. The spring is preferably prepared from iron or steel and made from tightly wound metal wire of preferably about ⅛ to ⅜ inch in diameter. The length of the coil may vary over a wide range as desired, but is preferably about 3 to 6 inches in length. The coil should obviously be of such strength that it can rapidly bring the pedistal back to its original place after the ball has been hit.

The bottom of the said coil spring is attached to a pivoting means, such as a metal ball joint, which allows the pedistal to be moved or pivoted inward, outward, front or back as desired to obtain the desired location of the ball. A locking means, such as the above-described lock bolt is utilized to keep the pedistal in the right position after it has been moved.

The device of the present invention may be utilized in a variety of different ways depending on the need for instruction in batting practice. As indicated, the device can be used for batting practice for baseball or for softball or for any other games involving the hitting of a ball with a bat, foot or racket.

For hitting balls of average height one would preferably use a device as shown with the pedistal being about 29 inches to 49 inches high. In the event practice for hitting low balls is needed, one may lower the height of the pedistal to about 14 to 29 inches.

In the event practice is needed for hitting outside balls the pedistal can be pivoted so that it is leaning to the outside, and for the hitting of inside balls, the pedistal can be pivoted so that it is leaning inwardly.

The device is operated by placing the plate on the ground or other solid surface and securing it to the same. The desired ball is then securely fixed to the top of the first vertical member of the pedistal as described above, and the batter takes his position and swings at the ball. On contact, the pedistal is bent forward, but then rapidly recovers its original position because of the coil spring at the base of the pedistal.

PREFERRED EMBODIMENT OF THE INVENTION

A preferred embodiment of the invention is described below. It should be understood, however, that this is given as a preferred assembly of apparatus for certain training schedules and is not to be regarded as limiting the invention in any way.

The preferred apparatus was prepared as follows: A base plate 17"×25" is made from a sheet of wood and rubber. A conventional ball joint of about 3"×3" was bolted to the middle of the plate and a lock bolt and sleeve placed thereover so as to secure the upright pedistal in the desired position. A heavy duty coil spring of about 6 inches in length with threaded metal ends was then attached to the top of the ball joint. The top end of the coil spring was threaded to engage with the bottom of the second resilient tubular member. This tubular member was a fiber glass tube of about 1 inch in diameter and having a length of about 5 inches. The bottom had a bolt molded in said end so as to screw into the top of the coil spring. A small fiber glass tube of about 8 inches in length was placed inside the second resilient tubular member and secured therein by a lock bolt which was threaded through an outside sleeve and into a threaded hole in the top of the second resilient tubular member. A plastic molded baseball was attached by use of a plastic mold to the top of the first resilient fiber glass tube. Such an apparatus was used numerous times with a short period as the usual time for retrieving the ball and placing it on the tee had now been eliminated.

I claim as my invention:

1. A ball hitting practice device comprising in combination:

a. a planar base adapted to being secured to a solid surface, and b. a vertical pedistal fixedly attached to the top surface of said base, said pedistal having a ball fixedly attached to the upper end thereof and having the bottom end thereof being fixedly attached to an elongated coil spring permitting the said vertical pedistal to bend when the ball is hit, pivoting means fixedly attached to the other end of the coil spring and to the surface of the planar base, said pivoting means permitting said vertical pedistal to be inclined to the side, front or back and then fixedly located in a desired position by locking means.

2. An adjustable ball hitting practice device as in claim 1 wherein the ball attached to the upper end of the vertical pedistal is a baseball.

3. An adjustable ball hitting practice device as in claim 1 wherein the ball attached to the upper end of the vertical pedistal is a softball.

4. An adjustable ball hitting practice device comprising in combination:

a. a planar base adapted to being secured to a solid surface, and b. a vertical pedistal fixedly attached to the top surface of said base, said pedistal comprising a first vertically extending resilient member having a ball fixedly attached to one end thereof and having its other end fitting into the upper end of a second vertically extending resilient tubular member in telescopic manner so as to permit said first resilient member to be adjusted up and down, locking means to secure said first resilient member in a desired position, an elongated coil spring having one of its ends fixedly attached to the bottom end of said second resilient member permitting the entire vertical pedistal to bend when the ball is hit, pivoting means fixedly attached to the other end of the coil spring and to the surface of the planar base, said pivoting means permitting said vertical pedistal to be inclined to the side, front or back and then fixedly located in a desired position by locking means.

5. An adjustable ball hitting practice device as in claim 2 wherein the ball is attached to an elongated rubber member which in turn is attached to the first resilient member.

6. An adjustable ball hitting practice device as in claim 2 wherein weight extension holders are attached to each side of the planar base and weights placed thereon to permit the practice hitting device to be placed indoors.

7. An adjustable ball hitting practice device as in claim 2 wherein the planar base possesses holes to permit metal stakes to be placed therein to secure the plate to the desired outdoor surface.

8. An adjustable ball hitting practice device as in claim 2 wherein the first and second resilient members are prepared from fiber glass and the planar base is prepared from hard rubber.

9. An adjustable ball hitting device as in claim 4 wherein said locking means is said locking a lock nut.

* * * * *